United States Patent [19]

Walther

[11] Patent Number: 4,502,400

[45] Date of Patent: Mar. 5, 1985

[54] SEWING MACHINE WITH A TRIMMING DEVICE

[75] Inventor: Karl H. Walther, Weilerbach, Fed. Rep. of Germany

[73] Assignee: Pfaff Industriemaschinen GmbH, Fed. Rep. of Germany

[21] Appl. No.: 438,803

[22] Filed: Nov. 3, 1982

[30] Foreign Application Priority Data

Nov. 12, 1981 [DE] Fed. Rep. of Germany ..... 3144965

[51] Int. Cl.[3] ..... D05B 37/06

[52] U.S. Cl. ..... 112/122

[58] Field of Search ..... 112/122, 129

[56] References Cited

U.S. PATENT DOCUMENTS 3,980,031 9/1976 Landwehr ..... 112/122

FOREIGN PATENT DOCUMENTS 1710923 7/1970 Fed. Rep. of Germany ..... 112/129

2357605 5/1975 Fed. Rep. of Germany ..... 112/129

*Primary Examiner*—Werner H. Schroeder

*Assistant Examiner*—Andrew M. Falik

*Attorney, Agent, or Firm*—McGlew and Tuttle

[57] ABSTRACT

A sewing machine includes a main shaft driving a sewing needle to reciprocate it through the material to be sewn which is fed over a needle slide of a stitch plate. The main shaft also drives a trimming knife drive which drives a reciprocating knife which cooperates with a counter blade adjacent the stitch plate for trimming the material. The trimming knife drive includes an eccentric driven by the main shaft and operating a knife operating linkage connected to reciprocate the knife. An eccentric rod is driven by the eccentric and it drives a swing lever through a guide rod which is pivoted thereto. The swing lever in turn drives the knife through a linkage connected between it and the knife and selectively moves it upwardly and downwardly for stopping its motion in either an upward or downward position. A device is connected to the eccentric rod so as to pivot the swing lever into a position in which it actuates the linkage to move the knife to its cutting position independently of the position of the eccentric.

5 Claims, 3 Drawing Figures

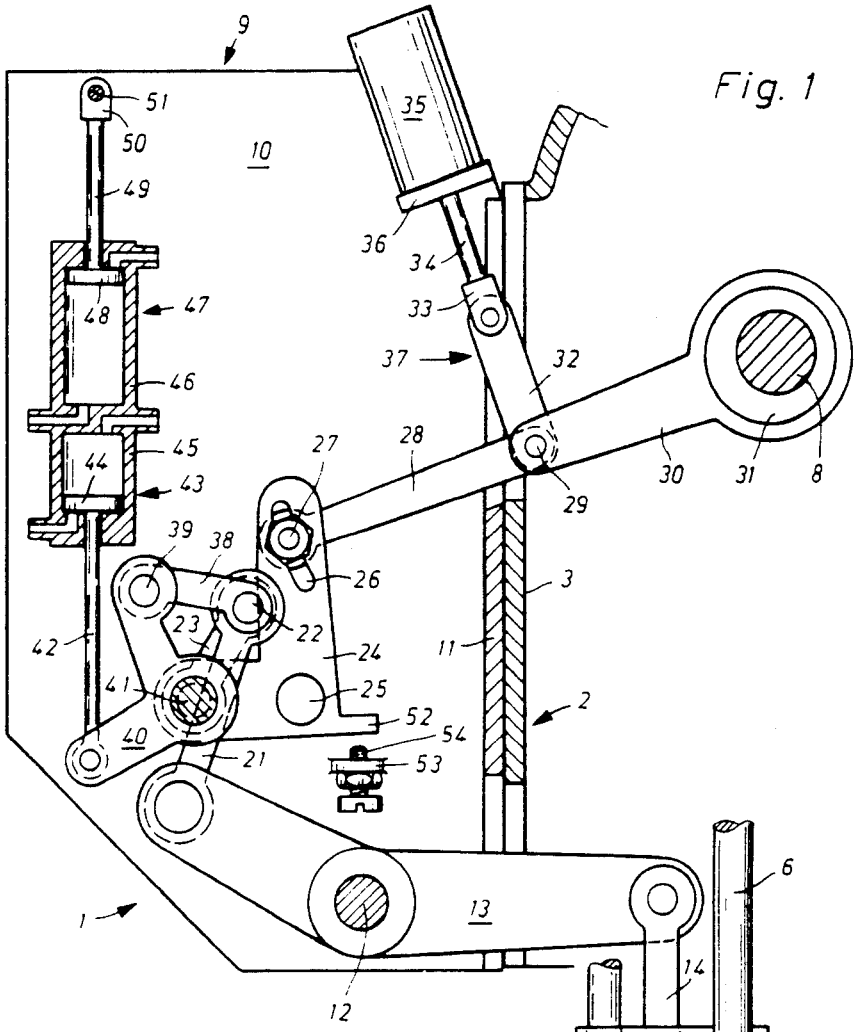
Fig. 1
Fig. 2
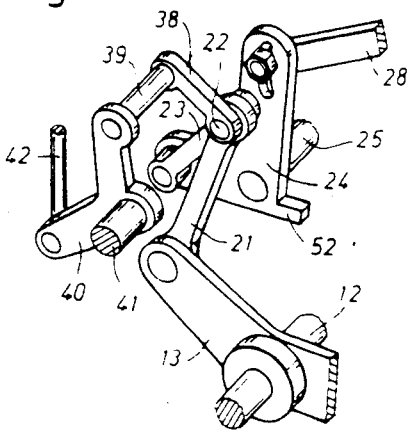

SEWING MACHINE WITH A TRIMMING DEVICE

FIELD AND BACKGROUND OF THE INVENTION

This invention relates in general to sewing machines and in particular to a new and useful sewing maching having a trimming device for the sewing material in which the trimming knife can be driven by a driving mechanism independently of the position of an eccentric.

A sewing machine with a trimming device for the sewing material, with a trimming knife and a gear which has a swing lever connected over an eccentric rod with an eccentric arranged on a shaft of the sewing machine, and a tramsission element moving relative to the swing lever, over which the trimming knife can be driven by a driving means independent of the trimming knife, is known from German Pat. No. 23 57 605. The trimming device of the sewing machine has a two-arm swing lever whose one arm is connected over an eccentric bar with an eccentric secured on the arm shaft, and whose other arm is connected over a transmission element secured thereon and a guide rod with a vertically guided trimming knife. In the transmission element, which is in the range of the axis of rotation of the swing lever, the trimming knife is raised into a rest position. But when the transmission element is at the end of the swing lever, the trimming knife is lowered into an operating position, and thus into the range of a counterknife. In this position, a bolt, which connects two tie rods articulted on the transmission element with a swiveling coupling part, locks into a recess, an entrained part which is secured at one end of a connecting rod. The other end of the connecting rod bears on an electromagnetically releasable ratchet. Behind the ratchet is arranged a wobble plate which is driven by a separate motor.

When the trimming device acts during the sewing, the trimming knife is driven by the eccentric and the needle work in synchronism. In order to prevent the trimming knife from being in the way when the workpiece advances, the eccentric is so designed that it moves the trimming knife downward only during the feeding intervals of the workpiece to carry out a trimming stroke.

In order to trim the edge of the workpiece in the corner range during the rotation of the workpiece about the needle axis when the sewing machine stands still, the ratchet is unlocked and at the same time a separate motor is started so that the connecting rod pressed by spring force onto a rotating wobble plate is set into a reciprocating motion. This motion is transmitted directly to the transmission element so that the trimming knife moves up and down. But the edge of the workpiece is only trimmed when the sewing machine has first been stopped with the eccentric in a trimming position, the arm carrying the swing lever is therefore in its lower swivel-position and the trimming knife moves up and down in the range of the counterknife. In order to be able to turn the workpiece properly in the corner region, the needle must be in its bottom position with the sewing machine standing still, so that it can act as an axis of rotation during the rotation of the workpiece.

But these different prerequisites for trimming, with the sewing machine running and standing still, can only be met if the known trimming device on a sewing machine is used with a bottom transport, because only in this type of sewing machine is the needle in its bottom position during the feeding phase of the workpiece, and the eccentric of the trimming device is necessary in trimming position with the sewing machine stopped in the bottom position of the needle.

But the known trimming device cannot be used for sewing machines with bottom and needle transport, because in this type of sewing machine, the needle serving amoung others as a feeding means is not in the bottom position during the feeding interval, but during the feeding movement of the workpiece. If it is desired to use the known trimming device on a sewing machine with under the needle transport and effect the trimming in the corner region of a workpiece with the sewing machine standing still and the needle in bottom position, the eccentric of the trimming device would be turned by 180° relative to the position of sewing machines with a bottom transport alone, so that the trimming during the sewing would necessarily take place during the feeding movement of the workpiece. In this case the workpiece moving relative to the known trimming knife would stall at the trimming knife and thus be movved out of the desired feeding direction.

SUMMARY OF THE INVENTION

The invention provides a trimming device which can be used both for sewing machines with bottom transport along and for sewing machines with bottom and needle transport.

Due to the fact that the swing lever can swing by means of an adjusting device into a position which is independent of the position of the eccentric and which corresponds substantially to its cutting position, the trimming device can be brought in practically any stopping position of the sewing machine into the starting position necessary for the trimming, with the sewing machine standing still. The swing lever can therefore also be turned in sewing machines with bottom and needle transport, with the needle down, and therefore the eccentric in a position turned by 180° relative to the cutting position, into the position which it assumes with the eccentric in cutting position. This way the up and down movement of the trimming knife caused by the additional driving means takes place in the range of the counterknife, so that a shearing effect of the two knives is produced.

According to another feature, the switching means for the switching handle carrying a vibration cylinder is designed as a pressure medium cylinder.

Accordingly it is an object of the invention to provide a sewing machine with a trimming device for the sewing material with a trimming knife and a gear which has a swing lever connected over an eccentric rod with an eccentric arranged on a shaft of the sewing machine, and a transmission element movable relative to the swing lever over which the trimming knife can be driven by driving means independently of the sewing needle, characterized in that the swing lever can be turned by an adjusting device into a position corresponding substantially to its cutting position but independently of the position of the eccentric.

A further object of the invention is to provide a sewing machine which is simple in design, rugged in construction and economical to manufacture.

The various features of novelty which characterize the invention are pointed out with particularity in the claims annexed to and forming a part of this disclosure.

For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWINGS

In the drawings:

FIG. 1 is a partial elevational and partial sectional view of a trimming device of a sewing machine in a position in which the drive is effected from the eccentric;

FIG. 2 is a perspective view of the switching mechanism driving linkage of the trimming device.

DESCRIPTION OF THE PREFERRED EMBODIMENTS

Figure 3:
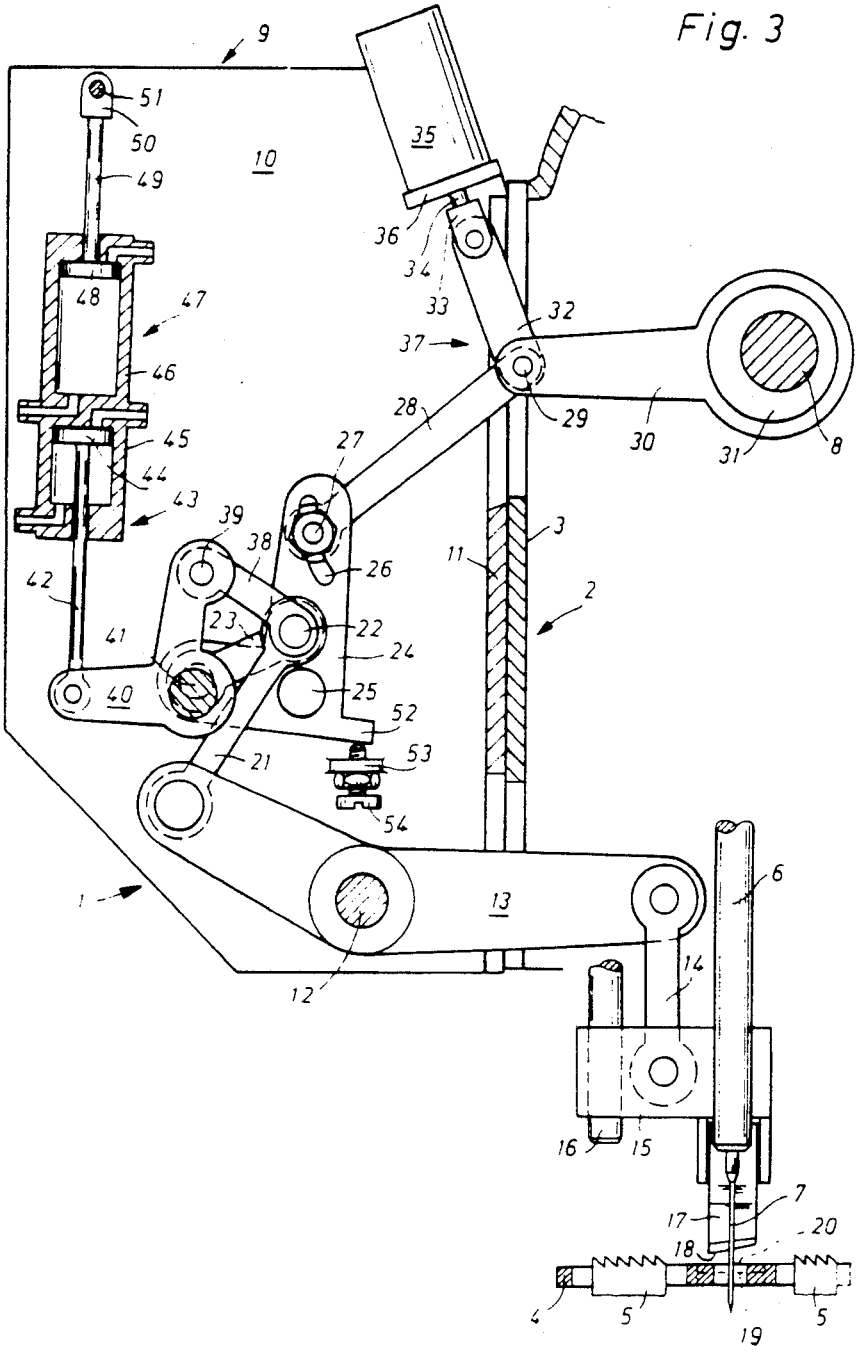
FIG. 3 is a view similar to FIG. 1 showing the parts in a position in which an additional driving means is effective to operate the trimming device.

Referring to the drawings in particular the invention embodied therein comprises a sewing machine generally designated 2 having a trimming device generally designated 1 which is operated from the main shaft 8 of the sewing machine which also drives a needle 7 reciprocated through a material to be sewn which is fed over a needle slot 20 of a stitch plate 4. The eccentric shaft 8 also actuates a trimming knife drive for driving a reciproacting trimming knife 17 which cooperates with a counterblade 19 adjacent the stitch plate, for example an edge 20 thereof for trimming the material. Trimming knife drive includes an eccentric 31 driven by the main shaft 8 and operating as a knife operating linkage connected to reciprocate the knife. The trimming knife drive also includes an eccentric rod 30 driven by the eccentric 31 to oscillate a swing lever 34 mounted adjacent the rod and connected to the rod through a guide rod 28 which is pivoted at each of its ends. The linkage is connected between the swing lever and the knife 17 to drive the knife upwardly and downwardly and to position it in selected positions in accordance with the operation to be desired. In accordance with the invention, the first device generally designated 37 is connected to the eccentric rod to pivot the swing lever 24 into a position in which it actuates the linkage to move the knife to its cutting position independently of the eccentric and fixing the knife in its cutting position.

Trimming device 1 is arranged on sewing machine 2, of which only the rear wall of casing 3, stitch plate 4, a cloth feed 5, and needle bar 6 with an inserted thread-carrying needle 7 are shown. Needle bar 6 is moved up and down by main shaft 8 over a known gear (not shown) for the purpose of forming a seam, and is moved swingingly about a horizontal axis extending parallel to main shaft 8 in order to enhance the feeding movement of cloth feed 5 driven in known manner. Trimming device 1 has a frame 9 of two parallel side plates 10 and a connecting plate 11, which is secured on casing 3 of sewing machine 2. On a bolt 12 secured in side plates 10 is pivotally mounted a two arm lever 13, at one end of which is arranged a guide rod 14. Guide rod 14 is jointed with a carrier 15 which moves up and down on a guide bar 16 secured on casing 3 in a manner not shown here. On carrier 15 is secured the trimming knife 17 with a cutting edge 18. Associated with trimming knife 17 is the counterknife 19 arranged in a recess (not shown) of stitch plate 4, which has likewise the cutting edge 20.

At the other end of lever 13 is arranged a guide rod 21 which is connected by a joint bolt 22 with another guide rod 23. Guide rod 23 is arranged at one end of an L-shaped swing lever 24, pivotally mounted on a bolt 25 which is secured in one of the side plates 10. In an oblong slot 26 provided at the other end of swing lever 24 is adjustably mounted a joint bolt 27. Guide rod 28 is connected by a joint bolt 29 with an eccentric rod 30, which embraces an eccentric 31 secured on main shaft 8. A connecting rod 32 connected to joint 29 and is connected over a yoke end 33 with a piston rod 34 of a compressed air cylinder 35. Compressed air cylinder 35 is secured on an extension 36 of frame 9. Compressed air cylinder 35, connecting rod 32 and guide rod 28 form an adjusting device 37.

A guide rod 38 is connected to joint bolt 22 and it is connected at its opposite end to a bolt 39 of an L-shaped switching handle 40. Switching handle 40 is pivotally mounted on a bolt 41, which is secured in one of the side plates 10 of frame 9. The other end of switching handle 40 is articulated with piston rod 42 of a compressed air cylinder 43, whose piston 44 is movable in a housing 45. Housing 45 is rigidly connected with housing 46 of a compressed air cylinder 47. Piston rod 49 of compressed air cylinder 47 is mounted over a yoke end 50 on a bolt 51 which is secured in one of the side plates 10 of frame 9.

Compressed air cylinder 43 has a stroke which is about half the size of that of compressed air cylinder 47 and it has a stroke high frequency so that it is also called a vibration cylinder.

Swing lever 24 is formed with an extension 52 to which is assigned a stop screw 54 arranged in extension 53 of side plate 10.

The trimming device works as follows:

For trimming a workpiece edge during sewing, the compressed air cylindes 43 and 47 are in the switching position shown in FIG. 1. In this switching position, guide rod 23 acting as a transmission element is extended so far over switching handle 40 and guide rod 38 that it extends substantially tangentially to the swing axis of swing lever 24 formed by bolt 25, and assumes practically the same inclined position as guide rod 21. Furthermore, compressed air cylinder 35 is pressurized so that piston rod 34 and connecting rod 32 keep guide 28 and eccentric rod 30 in an extended position.

With sewing machine 2 running, the swinging movement generated by the continuously driven eccentric 31 is transmitted over eccentric rod 30 and guide rod 28 to swing lever 24, which consequently performs a swinging movement about bolt 25. The swinging movement of swing lever 24 is transmitted over guide rod 23 and guide rod 21 to lever 13 which moves carrier 15 with trimming knife 17 up and down over guide rod 14.

In the position of eccentric 31 shown in FIG. 1, which is also called the backstroke position, trimming knife 17 is in the upper dead center of the up and down movement. The backstroke position of eccentric 31 occurs when the feed dog 5 and needle 7 are in position to make a stitch, that is, trimming knife 17 is raised when needle 7 is lowered and is in the workpiece. In the position of eccentric 31 turned by 180°, which is also called the cutting position, swing lever 24 is turned clockwise, so that it is likewise in its cutting position. The swinging movement of swing lever 24 is transmitted over guide rods 23, 21 to lever 13, so that trimming knife 17 is in the lower dead center of its up and down movement and is partly lowered into the recess (not shown) of stitch plate 4 in which counterknife 19 is arranged.

If the seam is to extend angularly in the corner region of a workpiece corresponding to the contour of the workpiece, sewing machine 2 is stopped with needle 8 in the bottom position, after which the workpiece is turned about needle 7 acting as an axis of rotation. To make sure that the edge of the workpiece also has a uniform distance from the seam, trimming knife 17 is moved up and down during the rotation of the workpiece, with sewing machine 2 standing still. To this end compressed air cylinder 35 is first so admitted that it retracts piston rod 34 and connecting rod 32. Guide rod 28 and eccentric rod 30 are thus brought into the bent position shown in FIG. 2, and swing lever 24 is turned clockwise until it bears with an extension 52 on stop screw 54. This way swing lever 24 is brought into a swivel position, with eccentric 31 in backstroke position, which corresponds substantially to its cutting position.

By turning swing lever 24 toward stop screw 54, trimming knife 17 is moved down, while compressed air cylinders 43, 47 remain in an unchanged switching position and a first cutting stroke is performed. Immediately thereafter, compressed air is alternately admitted by using a timing clock control means (not shown) into the two inlets in cylinder 43, which causes it to act as a vibration cylinder by alternately moving piston 44 up and down. During the ascending movement of piston 44 into the top position shown in FIG. 3, switching handle 40 is turned clockwise over guide 38, and also guide rod 23, so that joint bolt 22 is moved into a center position which is between the top position shown in FIG. 1 and the stationary bolt 25. By turning joint bolt bolt 22 down, guide rod 21 is also turned down, lever 13 is turned counterclockwise, and trimming knife 17 is raised into the position shown in FIG. 3.

With shaft 8 of sewing machine 2 standing still, the drive of trimming knife 17 is effected by compressed air cylinder 43 through the admission of compressed air with adjustable frequency in alternating directions. This results in a reciprocating movement of switching handle 40 and guide rod 23 which serves as a transmission element. Thus swing lever 24 is moved to a position independent of the stopped position of eccentric 31, which corresponds substantially to its cutting position.

After the rotation of the workpiece is completed, sewing machine 2 is again started, compressed air cylinder 43 is stopped in the bottom position of piston 44, and guide rod 28 and eccentric rod 30 are turned back into the bent position, after which eccentric 31 again drives trimming knife 17.

When the sewing speed in the sewing of narrow arcs and thus the cutting frequency corresponding to the speed of rotation of eccentric 31 becomes less than the cutting frequency that can be achieved by compressed air cylinder 43, guide rod 28 and eccentric rod 30 can be brought into the bent position, and with sewing machine 2 running, and compressed air cylinder 43 serving as an additional driving means, it is started in the above-described manner, that is, it is constantly admitted in alternating direction. In this case the swinging movement generated by the revolving eccentric 31 is no longer transmitted to swing lever 24 bearing on top screw 54. The swinging movement of eccentric 31 effects only a continuous reciprocating movement of guide rod 28 and eccentric rod 30 between a stronger and a weaker bent position, and consequently a reciprocating movement of connecting rod 32 and of piston rod 34. Since eccentric 31 thus has no effect on the movement of trimming knife 17, trimming knife 17 is driven in this case solely by compressed air cylinder 43, with the cutting frequency corresponding to the admission frequency.

If edges are to be trimmed during sewing, trimming device 1 is stopped by admitting compressed air into cylinder 47 which serves as a switching means in such a way that its housing 46 together with compressed air cylinder 43 move up relative to piston rod 49. Since the stroke of compressed air cylinder 47 is double the size of compressed air cylinder 43, switching handle 40 and guide 23 are turned clockwise to such an extent that joint bolt 22 is aligned with bolt 25. This has the result that trimming knife 17 is raised into a rest position which is relatively far from stitch plate 4, and that the swinging movement transmitted by eccentric 31 to swing lever 24 is no longer forwarded to guide rod 21. Trimming knife 17 therefore stands absolutely still in rest position, despite the driven swing lever 24.

While a specific embodiment of the invention has been shown and described in detail to illustrate the application of the principles of the invention, it will be understood that the invention may be embodied otherwise without departing from such principles.

What is claimed is:

1. A sewing machine having a trimming device with a trimming knife for trimming sewing material and a sewing machine drive mechanism which includes a swing lever connected through an eccentric rod with an eccentric arranged on a shaft of the sewing machine and a transmission element movable relative to the swing lever said swing lever having a cutting position in which said trimming knife is in a position to trim sewing material, and an adjusting device for turning said swing lever comprising a member movable against said eccentric rod to pivot said swing lever into a position corresponding substantially to its cutting position and for fixing said swing lever in its cutting position, independently of the position of said eccentric, whereby said trimming knife can be driven by means undependent of said sewing machine drive.

2. In a sewing machine including a main shaft driving a sewing needle to reciprocate the sewing needle through material to be sewn, which material is fed over a needle slot of a stitch plate and for also actuating a trimming knife drive for driving a reciprocating knife which cooperates with a counter blade adjacent the stitch plate for trimming the material, said trimming knife drive including an eccentric driven by the main shaft and operating a knife operating linkage connected to reciprocate the knife, an eccentric rod driven by said eccentric, a swing lever pivotally mounted adjacent said eccentric rod, a guide rod pivotally connected between said eccentric rod and said swing lever, and a linkage connected between said swing lever and said knife for driving said knife upwardly and downwardly and having a first position for positioning said knife upwardly and a cutting position for positioning said knife downwardly, the improvement comprising a first device connected to said guide rod to pivot said swing lever into its cutting position in which it actuates said linkage to move said knife into its downward position for trimming material, and for fixing said swing lever in its cutting position, independently of said eccentric, whereby said trimming knife can be driven by means independent of said main shaft drive means.

3. In a sewing machine including a main shaft driving a sewing needle to reciprocate the sewing needle through material to be sewn, which material is fed over a needle slot of a stitch plate and for also actuating a trimming knife drive driving a reciprocating knife which cooperates with a counterblade adjacent the stitch plate for trimming the material and for holding the material for pivoting thereof, said trimming knife drive including an eccentric driven by the main shaft and operating a knife operating linkage connected to reciprocate the knife, an eccentric rod driven by said eccentric, a swing lever pivotally mounted adjacent said eccentric rod, a guide rod pivotally connected at a joint between said eccentric rod and said swing lever, and a linkage connected between said swing lever and said knife to drive said knife upwardly and downwardly and to position it either upwardly in a first position of said swing lever or downwardly in a cutting position of said swing lever, the improvement comprising a first device connected to said rod to pivot said swing lever into said cutting position for actuating said linkage to move said knife to its downward position independently of said eccentric and to fix said swing lever in its cutting position, whereby said trimming knife can be driven by means independent of said main shaft drive said device includes an air cylinder having a piston movable therein with a connecting rod connected to the joint between said eccentric rod and said guide rod and including a stop alongside said swing lever for limiting the pivotal movement thereof.

4. A sewing machine having a trimming device with a knife for the sewing material and a drive mechanism which includes a swing lever connected through an eccentric rod with an eccentric arranged on a shaft of the sewing machine and a transmission element movable relative to the swing lever, said swing lever having a cutting position in which said knife is movable into a position to trim material, and an adjusting device for turning said swing lever comprising a member movable against said eccentric rod to pivot said swing lever into its cutting position independently of a position of said eccentric and to fix said swing lever in said cutting position, said linkage includes means which drives said knife independent by of said sewing machine drive mechanism comprising additional guide rods and a double armed lever having one arm connected to said knife for raising and lowering said knife and a switching handle connected to said swing lever, a switching device connected to said switching handle for shifting said swing lever between a rest position and said cutting position, said switching means including a vibration cylinder connected to said switching handle.

5. In a sewing machine according to claim 4, wherein said switching means includes fluid pressure cylinder having a first cylinder part with a first piston therein having a connecting rod connected to said swing lever and a second cylinder part being twice the length of said first part having a piston movable therein with a second piston rod and means for pivoting said second piston rod on said sewing machine.

* * * * *